US010202565B2

(12) United States Patent
Roselle

(10) Patent No.: US 10,202,565 B2
(45) Date of Patent: Feb. 12, 2019

(54) CONTAINER FOR FABRIC TREATMENT COMPOSITION

(71) Applicant: Whirlpool Corporation, Benton Harbor, MI (US)

(72) Inventor: Brian Joseph Roselle, Fairfield, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 516 days.

(21) Appl. No.: 14/565,855

(22) Filed: Dec. 10, 2014

(65) Prior Publication Data

US 2016/0168518 A1 Jun. 16, 2016

(51) Int. Cl.

| | |
|---|---|
| ***C11D 17/04*** | (2006.01) |
| ***D06F 39/02*** | (2006.01) |
| ***D06F 58/20*** | (2006.01) |

(52) U.S. Cl.

CPC ..... *C11D 17/047* (2013.01); *C11D 17/041* (2013.01); *D06F 39/022* (2013.01); *D06F 58/203* (2013.01)

(58) Field of Classification Search

CPC ... C11D 17/047; C11D 17/041; D06F 58/203; D06F 39/022

See application file for complete search history.

(56) References Cited

U.S. PATENT DOCUMENTS 3,373,902 A * 3/1968 Laufer, Sr. ..... A47L 15/4418 222/133
3,373,905 A * 3/1968 Laufer, Sr. ..... A47L 15/4418 134/100.1
3,375,056 A * 3/1968 Rosan ..... A47K 5/1201 401/186
5,273,186 A * 12/1993 Widmer ..... G01F 11/025 222/105
6,109,480 A * 8/2000 Monsrud ..... A47L 15/4418 222/83
6,439,387 B1 8/2002 Bergman
7,833,359 B2 * 11/2010 Suzuki ..... C11D 1/722 134/42
2002/0079329 A1 * 6/2002 Verherbrugghen ..... A47K 5/12 222/143
2002/0108969 A1 * 8/2002 Rodd ..... A47L 15/44 222/209

(Continued)

FOREIGN PATENT DOCUMENTS

GB 2391532 A * 2/2004 ..... A47L 15/44

*Primary Examiner* — Michael E Barr
*Assistant Examiner* — Benjamin L Osterhout
(74) *Attorney, Agent, or Firm* — Price Heneveld LLP

(57) ABSTRACT

A container for a fabric treatment composition having: (a) a container floor extending to a floor boundary; (b) a sump adjacent to at least a portion of the container floor, wherein a portion of the container floor adjacent the sump has a container floor elevation head, wherein the sump has a sump elevation head less than the container floor elevation head adjacent the sump, at least a portion of the sump being located on a longitudinal axis of the container; (c) a peripheral wall extending from the container floor; and (e) a needle piercable membrane operatively engaged with the peripheral wall to define an interior volume, wherein the interior volume contains between about 10 mL and about 100 mL a liquid fabric treatment composition.

20 Claims, 11 Drawing Sheets

(56) References Cited

U.S. PATENT DOCUMENTS

| | | | | |
|---|---|---|---|---|
| 2006/0102656 | A1* | 5/2006 | Troost | A61K 8/11 222/132 |
| 2006/0272359 | A1* | 12/2006 | Kang | D06F 39/02 68/17 R |
| 2008/0203114 | A1* | 8/2008 | LaFlamme | B05B 11/0072 222/207 |
| 2008/0277370 | A1* | 11/2008 | Mikkelsen | D06F 39/022 215/247 |
| 2009/0100881 | A1* | 4/2009 | Dahlke | D06F 39/022 68/17 R |
| 2010/0071777 | A1* | 3/2010 | Smith | D06F 39/022 137/14 |
| 2015/0001230 | A1 | 1/2015 | Bischoff et al. | |

* cited by examiner

CONTAINER FOR FABRIC TREATMENT COMPOSITION

FIELD OF THE INVENTION

Container for fabric treatment composition.

BACKGROUND OF THE INVENTION

As the members of a typical household have become increasingly busier, the amount of time that persons have to devote to laundering clothing has decreased. The decrease in time available for doing the laundry has unfortunately not been accompanied by a decrease in the number of clothing articles worn by a typical person in a fixed period of time, for example, a week. With the advent of specialized clothing articles for different activities, for example cycling, golf, yoga, aerobics, zumba, office work, kickboxing, martial arts, and running, the number of clothing articles worn by a person in a week has increased. Thus, consumers are interested in ways to quickly refresh clothing that is not heavily soiled or malodorous, without having to pass the article of clothing through a laundry washing machine and dryer. Further, consumers are interested in ways to avoid subjecting expensive clothing to the rough conditions found in a washing machine.

Current ways to quickly refresh clothing are thought to be able to reduce odors and wrinkles in previously worn clothing articles. For instance, fabric refreshing cabinets that apply steam or a mist of water to one or more garments contained therein and then dry the garments within the cabinet have been developed. Although these devices are described to provide freshening and dewrinkling benefits, it has been found that the devices do not provide sufficiently crisp appearance and feel within a limited amount of time and energy use.

Steam based devices for treating fabrics typically heat a volume of water to boiling point, thereby generating steam. Heating the water to boiling point requires a considerable amount of energy and heat. Further, the heating device used by the apparatus requires a certain amount of time to reach the temperature required to heat the water to boiling temperature. Typically, the device does not activate the heating element until the user inserts clothing and turns the device on. This process typically takes a long time to run and complete the treatment cycle. Consumers have been found to desire the treatment to be completed in a short amount of time such that the fabrics can be treated within the amount of time it would typically take a consumer to conduct his or her hygiene and beauty routines.

Another type of fabric treating device is one that distributes fluids, such as water and/or chemical compositions, onto the fabrics by misting within the device or distributing the fluid directly onto the fabrics through ultrasonic nebulizers. In a typical embodiment, a device is provided that has a large reservoir to hold a volume of chemical composition sufficient to treat multiple garments over many uses.

Providing the consumer the opportunity to store a large volume of chemical composition with the device can be practical since the consumer will have to open the reservoir on the device, for instance by disengaging a threaded cap, then open the container that was purchased in a store, and then pour the chemical composition from the container purchased from the store, and then reclose the reservoir on the device, and then reclose or dispose of the container that was purchased from the store. It is thought that by providing a reservoir that can contain a large volume of chemical composition it is convenient to the user since she will only infrequently need to add chemical composition to the device.

One problem with the approach of providing a large reservoir with the device is that the user has little flexibility to choose different chemical compositions for different articles of clothing. For instance, the chemical composition that performs best when dewrinkling or crisping a wool suit may be quite different from a chemical composition that is particularly designed for athletic wear due to the nature of the different types of fibers found in each article of clothing.

Another problem with the approach of providing a large reservoir with the device is that the user has little flexibility to choose different scents for different articles of clothing or even the same type of clothing. It is thought that by repeated exposure to a particular scent, the person smelling such scent can become desensitized to such scent and derive little pleasure from retrieving a refreshed garment from the device and wearing the article. Further, different scents may be desired for different circumstances, for example a business day or an evening social engagement.

With these limitations in mind, there is a continuing unaddressed need for a single use container for a fabric treatment composition that can be individually inserted into a fabric refreshing device to dose the fabric treatment composition.

SUMMARY OF THE INVENTION

A container for a fabric treatment composition having: (a) a container floor extending to a floor boundary; (b) a sump adjacent to at least a portion of the container floor, wherein a portion of the container floor adjacent the sump has a container floor elevation head, wherein the sump has a sump elevation head less than the container floor elevation head adjacent the sump when the container is in an in-use position, at least a portion of the sump being located on a longitudinal axis of the container; (c) a peripheral wall extending from the container floor; and (d) a needle piercable membrane operatively engaged with the peripheral wall to define an interior volume, wherein the interior volume contains between about 10 mL and about 100 mL of a liquid fabric treatment composition.

DETAILED DESCRIPTION OF THE INVENTION

Figure 1:
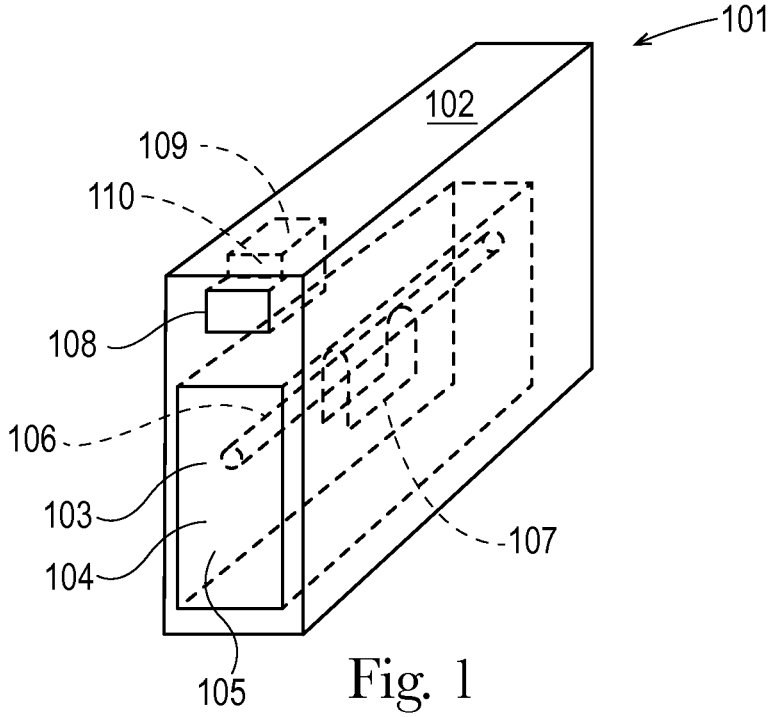
FIG. 1 is a schematic of a fabric refreshing cabinet device.

Single use containers for containing a fabric treatment composition are practical for use in a variety of fabric refreshing cabinet devices 101. A schematic of a fabric refreshing cabinet device 101 is shown in FIG. 1. A fabric refreshing cabinet can comprise: a shell 102 which may be in the form of a non-collapsing cabinet comprising an opening; and an extractable pull-out drawer 103 comprising: a drawer face 104 comprising an outer surface 105; a supporting member 106 such as a rod, pole, beam, hooks or other member capable of suspending a fabric 107 or a fabric 107 hung upon a fabric hanging member such as a hanger, wherein the drawer face 104 and the supporting member 106 form a receiving region adapted to operatively support a fabric 107, and wherein the extractable pull-out drawer 103 is adapted to fit within the shell 102; a heating element contained within the device; and an air flow path positioned to direct air through the receiving region 111 containing the support member 106. The extractable pull-out drawer 103 can be slideably engaged with the shell 102. As used herein, fabrics include one or more items of clothing, garments, textiles, towels, table cloths, drapes, chair covers, and the like.

In one non-limiting embodiment, the fabric refreshing cabinet device 101 can comprise a footprint that is compact in width such that the device can be used in a bedroom, closet or other living space where larger wider devices are inconvenient. A small footprint for a present fabric refreshing cabinet device 101 can be achieved using an extractable pull-out drawer 103 design. An extractable pull-out drawer 103 can be preferred over a hinged door since an extractable pull-out drawer 103 can require less space than a hinged door.

The side portions of the shell can comprise one or more dispensing heads (including but not limited to sprayer heads, hydraulic nozzles, sonic or ultrasonic nebulizers, pressure swirl atomizers, high pressure fog nozzle, and combinations thereof) positioned at a desired distance from any fabrics contained within the device.

Since space in a consumer's home is often at a premium, it is desirable for the fabric refreshing cabinet device 101 to be small. The container for containing a fabric treatment composition disclosed herein can be an important aspect for making a small fabric refreshing cabinet device 101. For instance, if the fabric refreshing cabinet device 101 is provided with a large reservoir for containing fabric treatment composition, the fabric refreshing cabinet device must include space for such a large reservoir. A small compact container for containing a fabric treatment composition will take up less space in the fabric refreshing cabinet device than a large reservoir. At a minimum, the container for containing a fabric treatment composition can contain a volume of liquid fabric treatment composition sufficient for a single run cycle of the fabric refreshing cabinet device.

As shown in FIG. 1, the fabric refreshing cabinet device 101 can have a port 108 sized and dimensioned for receiving a container for a fabric treatment composition. An extraction device 109 can be provided with the fabric refreshing cabinet device 101 for extracting liquid fabric treatment composition from the container for a fabric treatment composition. The extraction device 109 can comprise a moveable cannula 110 having suction applied there to that penetrates the container and extracts the liquid fabric treatment composition from the container. The extraction device 109 can transport the liquid fabric treatment composition downstream to the location from which the liquid fabric treatment composition is applied to the fabric 107. For instance the extraction device 109 can dispense the fabric treatment composition through nozzles that are aimed at the fabric 107 being treated.

Figure 2:
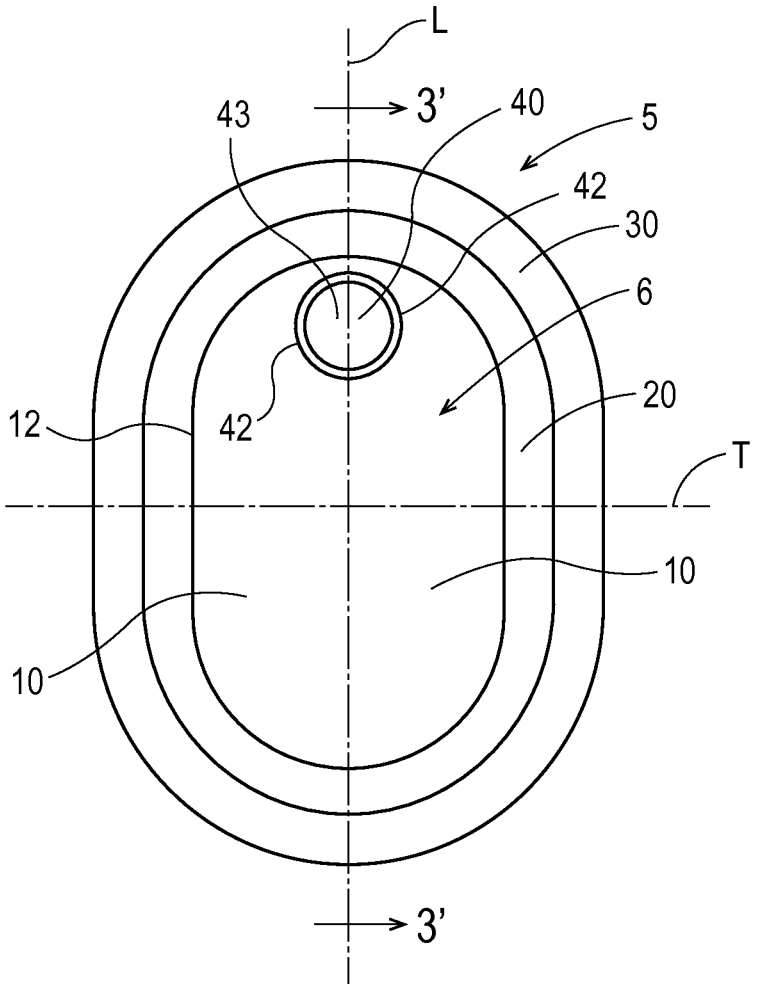
FIG. 2 is a top view of a container devoid of a needle piercable membrane.

A top view of a container 5 is shown in FIG. 2. The container 5 can be sized and dimensioned to be receivable by a port 108 in a fabric refreshing cabinet device 101. The container 5 can have a container floor 10 extending to a floor boundary 12. The floor boundary 12 can define the edge of the container floor 10. The peripheral wall 20 can extend upward from the floor boundary 12. The container floor 10 can be substantially flat.

The container floor 10 can have a container floor elevation head. The container floor elevation head can be non-uniform. That is, the elevation head of various parts of the container floor 10 can differ from one another. A portion of the container floor 10 adjacent the sump 40 can be considered to have a container floor elevation head. The container floor elevation head of various parts of the container floor 10 is determined when the container 5 is in an in-use position. In the in-use position the peripheral flange 30 is above the container floor 10.

The container 5 can further comprise a sump 40 adjacent to at least a portion of the container floor 10. The sump 40 has a sump elevation head that is less than the container floor elevation head adjacent the sump 40. The sump elevation head is determined when the container 5 is in an in-use position. That is, when the container 5 is in-use, the sump 40 is lower than the container floor 10 adjacent the sump 40 and thereby the sump 40 can serve as a location from which the liquid fabric treatment composition can be collected. The container floor elevation head can be taken relative to the peripheral flange 30. The sump 40 can be located on the longitudinal axis L of the container 5.

The container 5 can have longitudinal axis L and a transverse axis T, the transverse axis T being orthogonal to the longitudinal axis L. The sump 40 can be located such that at least a portion of the sump is located on the longitudinal axis L of the container 5. It can be desirable to have at least a portion of the sump 40 located on the longitudinal axis L so that if the liquid fabric treatment composition is extracted near or close to the container floor boundary 12, a cannula puncturing the needle piercable membrane does not tip the container about an axis parallel to the longitudinal axis or off-axis from the longitudinal axis. It can also be desirable to have at least two sumps 40 located opposite to one another on opposing sides of the transverse axis T. Such an arrangement can permit the consumer to insert the container 5 into the port 108 in at least two orientations in which liquid fabric treatment composition can be extracted from the container 5.

The container 5 can extend along the longitudinal axis L between about 60 mm and about 200 mm, alternatively between about 90 mm and about 120 mm, or even about 95 mm. The container 5 can extend along the transverse axis T between about 20 mm and about 100 mm, alternatively between about 50 mm and about 70 mm, or alternatively about 67 mm.

Figure 3:
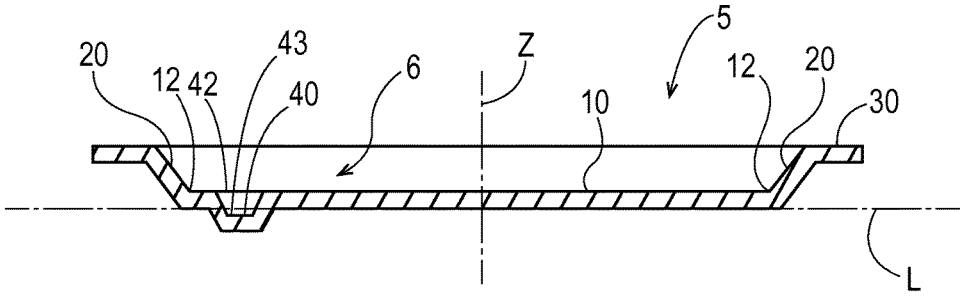
FIG. 3 is a cross section of the container shown in FIG. 2, the cross section taken along 3-3' as indicated in FIG. 2.

A cross-section of the portion of the container 5 rendered in FIG. 2 is shown in FIG. 3. As shown in FIG. 3, the container 5 can have a vertical axis Z extending orthogonal to the longitudinal axis L and transverse axis T.

The container 5 can have a sump 40. The sump 40 is a low portion of the container 5 relative to the container floor 10 adjacent the sump 40. The sump 40 can be a discrete region or line having an elevation head or average elevation head less than the elevation head or average elevation head of the container floor 10. The sump 40 can provide for enhanced extraction capability from the container 5 in that fluid on the container floor 10 can tend to flow towards the sump 40. Further, the sump 40 can provide for positive nesting with a recess in the port 108 of the fabric refreshing cabinet device 101. For instance the port 108 may have a contoured recessed surface that is a negative surface and the sump 40 defines a positive surface of the exterior of the container 5 that nests into the recess. This arrangement can provide for enhanced stability of the container 5 with respect to the port 108 when the needle piercable membrane is pierced. Further, the sump 40 can be desirable from a container 5 processing view point. For example, by having the sump 40, the containers 5 can be stacked compactly and relatively securely after they are manufactured and before filling with liquid fabric treatment composition.

The sump 40 can be surrounded by the container floor 10 or a portion of the container floor 10 so that the sump is effectively the low point of the container 5 and the container floor 10 and peripheral wall 20 can convey the liquid fabric treatment composition to the sump 40.

The sump 40 can extend along the longitudinal axis L between about 2 mm and about 40 mm. The sump 40 can extend along the longitudinal axis L between about 3 mm and about 10 mm. The sump 40 can be shaped so that it is open in a direction aligned with the vertical axis Z.

The peripheral wall 20 extends from the container floor 10. The peripheral wall 20 serves to provide depth to the container 5. From a practical viewpoint, the container floor 10 and sump 40 can form the bottom of the container 5 and the peripheral wall 20 can define the walls of the container to form the container 5. The peripheral wall 20 can extend between the floor boundary 12 and the peripheral flange 30. The peripheral wall 20 can intercept the floor boundary 12 at an angle of about 45 degrees. The peripheral wall 20 can comprise one or more cylindrical sections. The peripheral wall 20 can comprise one or more frusto-conical sections.

The peripheral wall 20 can extend between about 12 mm and about 50 mm, alternatively between about 20 mm and about 30 mm, or even about 27 mm, in the direction measured orthogonal to the longitudinal axis L and the transverse axis T in the Z direction.

A peripheral flange 30 can extend from the peripheral wall 20 in a direction away from the container floor 10. The peripheral flange 30 can provide a surface to which the needle piercable membrane can be sealed. The peripheral flange 30 can be, by way of non-limiting example a flat surface or a contoured surface. The peripheral flange 30 need only have a sufficient surface area to bond the needle piercable membrane to the peripheral flange 30 so that the needle piercable membrane can remain sealed to the peripheral flange 30 during packaging, shipping, storage, display, transport to the consumer's home, storage in the home, and handling in the home.

The peripheral flange 30 can extend outwardly from the peripheral wall 20 in a direction away from the container floor 10 by between about 2 mm and about 15 mm, alternatively about 5 mm to about 10 mm, alternatively about 9 mm. The peripheral flange 30 can extend outwardly from the peripheral wall 20 in a direction away from the container floor 10 by more than about 1 mm, by more than about 3 mm, and alternatively by more than about 5 mm. The peripheral flange 30 can be a flat surface. The peripheral flange 30 can extend entirely about the peripheral wall 20.

Figure 4:
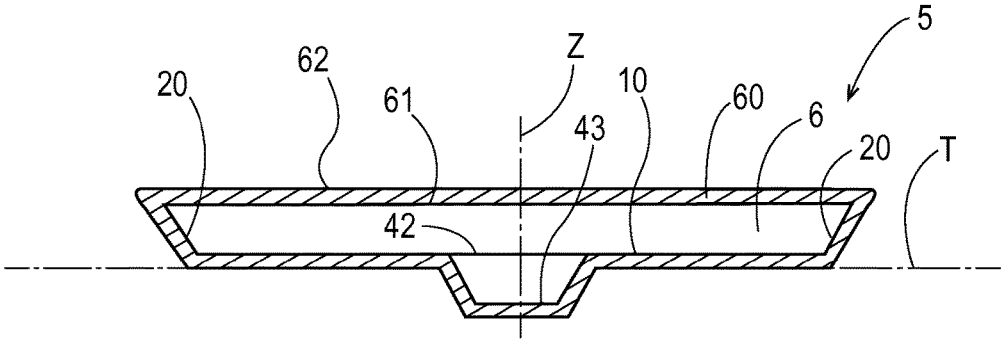
FIG. 4 is side view of a container.

A needle piercable membrane 60 can be operatively engaged with the peripheral wall 20 to define an interior volume 6, as shown in FIG. 4. By operatively engaged with respect to the needle piercable membrane 60 and peripheral wall 20, it is meant that the needle piercable membrane 60 is attached, or connected, or integral to the peripheral wall 20 either directly; or indirectly, wherein the needle piercable membrane 60 is attached, or connected, or integral to the peripheral flange 30 which is in turn attached, or connected, or integral to the peripheral wall 20 either directly; or indirectly.

Figure 5:
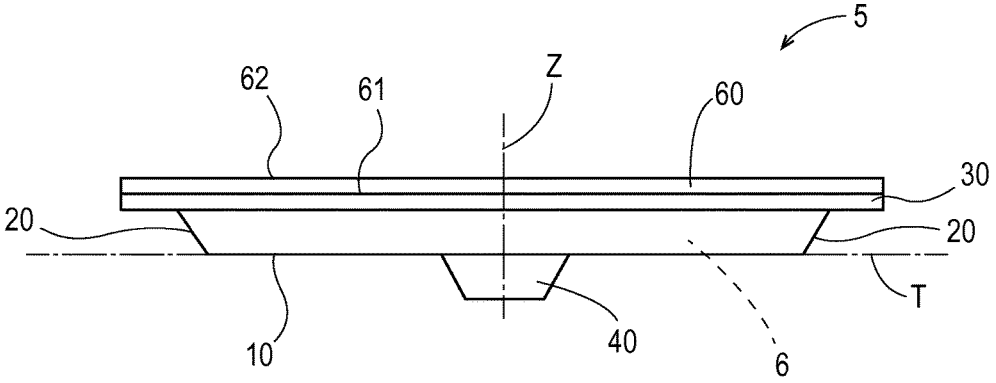
FIG. 5 is a side view of a container.
Figure 6:
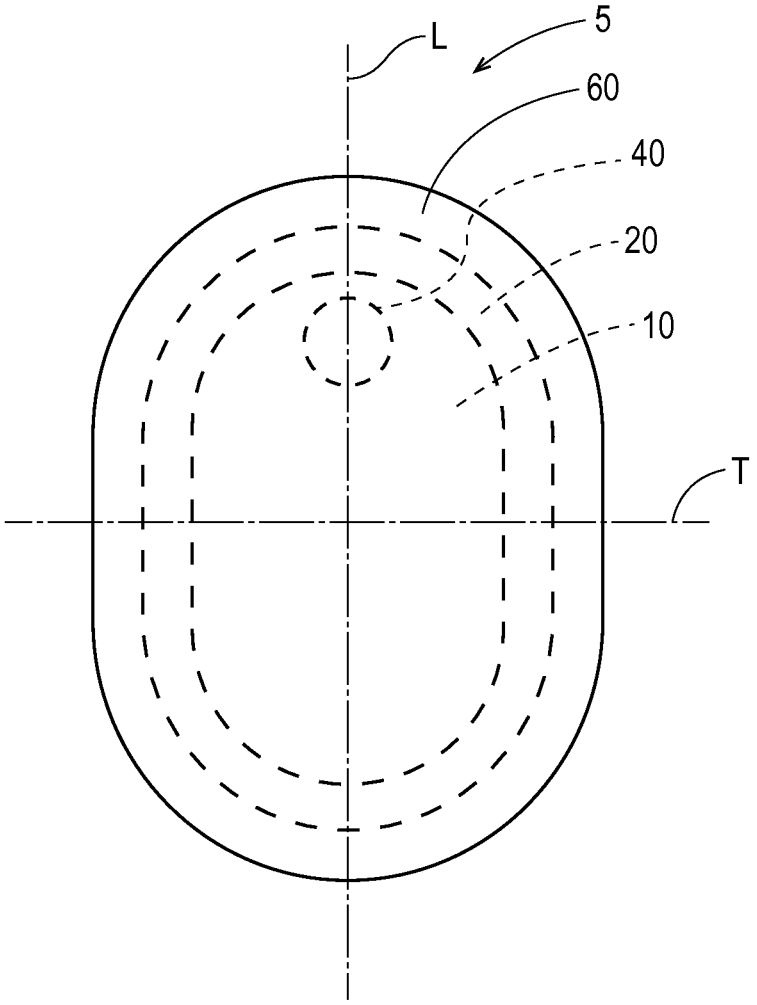
FIG. 6 is a top view of a container.

A needle piercable membrane 60 can be sealed to the peripheral flange 30 to define an interior volume 6, as shown in FIG. 5. The needle pierceable membrane 60 can be sealed to the peripheral flange 30 entirely about the peripheral flange 30. The needle piercable membrane 60 can have an inner surface 61 oriented towards the container floor 10 and an outer surface 62 oriented away from the container floor 10. The interior volume 6 can contain between about 10 mL and about 100 mL of liquid fabric treatment composition. The interior volume 6 can be between about 20 mL and about 200 mL, alternatively between about 50 mL and about 100 mL, alternatively between about 60 mL and about 80 mL. A top view of the container 5 shown in FIG. 5 is shown in FIG. 6.

The container 5 can comprise a material selected from the group consisting of polyethylene terephthalate, polypropylene, high impact polystyrene, polyethylene, high density polyethylene, polyvinyl chloride, and combinations thereof. The container floor 10, peripheral wall 20, and peripheral flange 30, can be comprised of such previously mentioned materials and can comprise monolayers or laminates of such materials and each element can be comprised of the same material and or structure or each element can comprise a different material and or structure. The container floor 10, wall 20, and peripheral flange 30 can have a thickness less than about 1 mm.

The needle piercable membrane 60 can be a laminate material. The needle piercable membrane 60 can comprise a layer of 40# paper and 0.35 mil thick foil bonded to one another with a coextruded layer of #7 polyethylene to bond the paper and foil layers. The needle piercable membrane 60 can be formed by extrusion lamination. The needle piercable membrane 60 can be adhesion laminated to the peripheral flange 30 of the container with an adhesive. The adhesive can be chemically compatible with the fabric treatment composition and have sufficient peel strength so that the needle piercable membrane cannot be easily removed from the container 5 or cannot be removed from the container 5 without destroying the needle piercable membrane 60.

Figure 7:
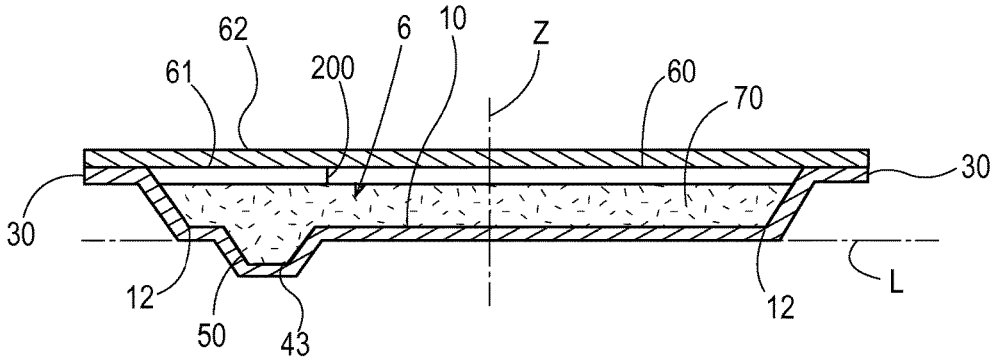
FIG. 7 is a side cross sectional view of a container.

A cross section of a container 5 containing fabric treatment composition 70 is shown in FIG. 7. As shown in FIG. 7, head space 200 can be provided between the fabric treatment composition 70 and the needle piercable membrane 60. The head space 200 can be measured as the distance between the inner surface 61 of the needle piercable membrane 60 and the fabric treatment composition 70. A least about 2 mm of head space 200 can be provided. At least about 4 mm of head space 200 can be provided. At least about 6 mm of head space 200 can be provided. Providing head space 200 in this manner is thought to be practical in that it can help to avoid splashing during filling of the container 5 on a manufacturing line. Further, providing head space 200 can help to accommodate the effects of temperature change on the fabric treatment composition 70, air in the head space 200, and off gassing that might occur from the fabric treatment composition 70.

As shown in FIG. 2, the sump 40 can be symmetric in a plane defined by the longitudinal axis L and transverse axis T. For instance, the sump 40 can have a sump periphery 42 that is a circle, oval, rectangle, square, or other shape.

Further, the sump 40 can be desirable from a container 5 processing view point. For example, by having the sump 40, the containers 5 can be stacked compactly and relatively securely after they are manufactured and before filling with liquid fabric treatment composition 70.

Figure 8:
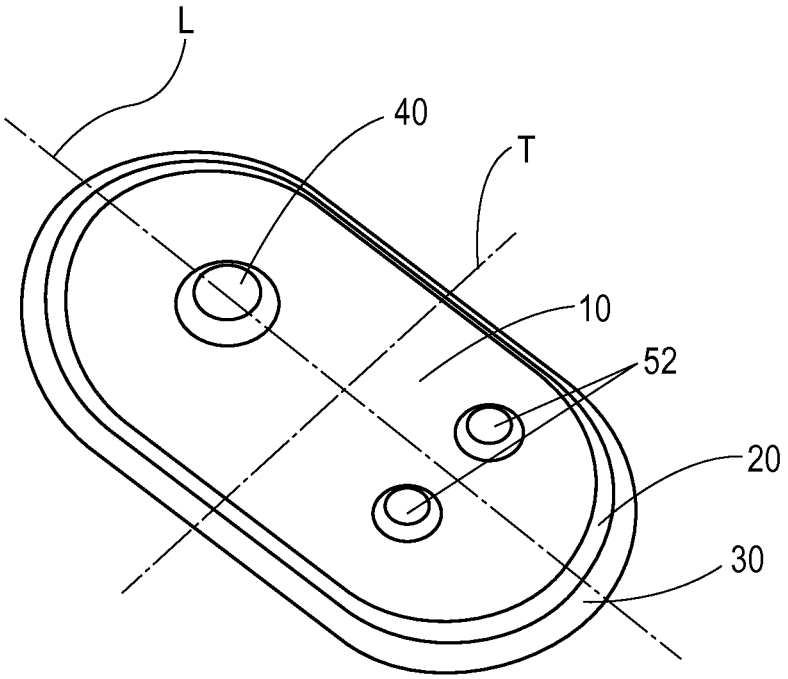
FIG. 8 is a perspective view of the bottom of a container.

As shown in FIG. 8, when the container 5 is resting on a flat surface with the container floor 10 oriented towards the flat surface, the peripheral flange 30 can be parallel to the flat surface. Such an arrangement can be practical in that the container 5 will be stable when resting on a flat surface. This can be provided for, by way of non-limiting example, by a plurality of sumps 40 spaced apart from one another, by providing one or more legs 52 in addition to a sump 40, or other configuration that operatively renders the container 5 to be stable when resting on a flat surface. This can make it easy for the consumer to set the container 5 on a table or shelf after she has removed the container from a package comprising a plurality of containers 5 prior to installing the container 5 in the fabric refreshing cabinet device 101. Further, such container 5 optionally can be sized and dimensioned to rest stably within the port 108.

Figure 9:
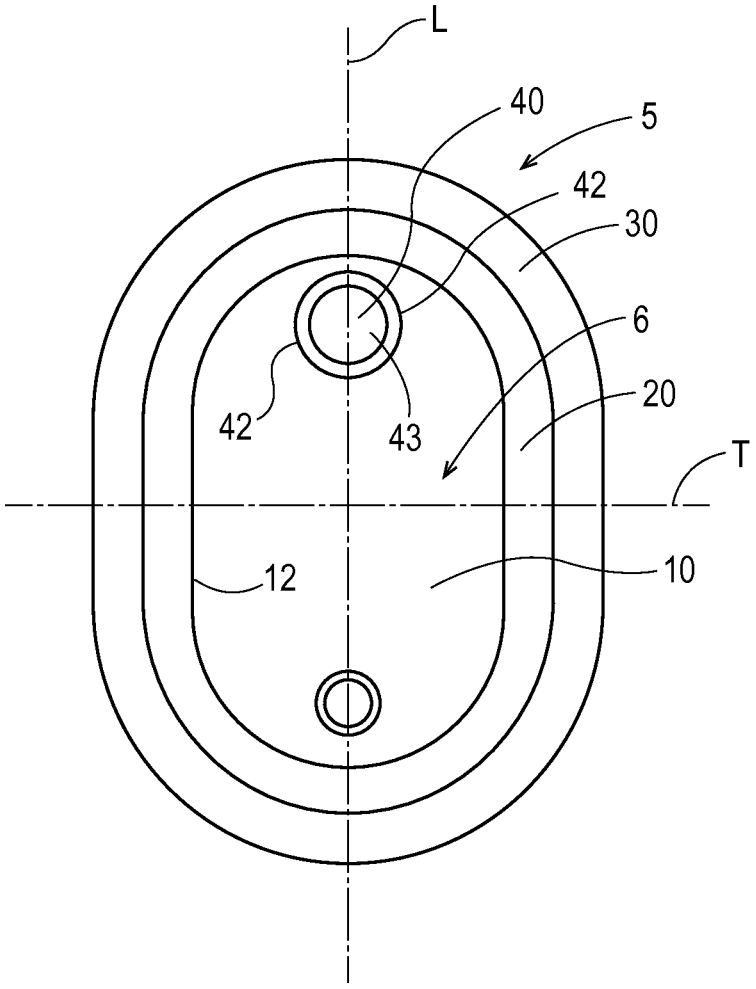
FIG. 9 is top view of a container.

The container 5 can comprise a plurality of sumps 40 and the transverse axis T can be between the sumps, by way of non-limiting example as shown in FIG. 9. For example, it can be practical to have sumps 40 located at opposing longitudinal ends of the container 5. This can permit the user to install the container 5 into the fabric refreshing cabinet device 101 in multiple directions which can make the container 5 easier to use as compared to a container 5 having a single sump 40 located at one longitudinal end of the container 5.

Figure 10:
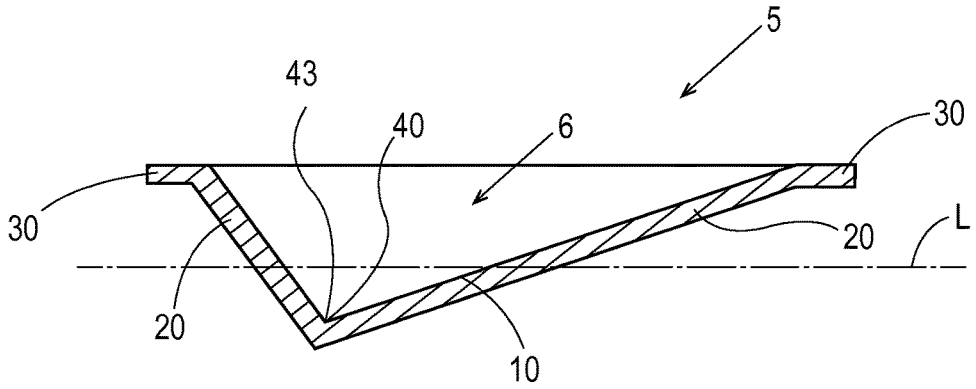
FIG. 10 is a cross section of a container.
Figure 11:
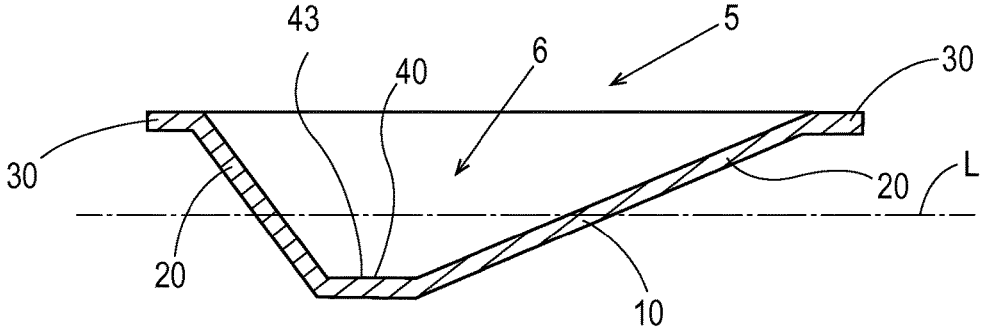
FIG. 11 is a cross section of a container.

As described herein, the container floor 10 need not be entirely flat or level. For example, the container floor 10 can have an irregular surface. The container floor 10 can be sloped towards the sump 40, by way of non-limiting example as shown in FIGS. 10 and 11. As shown in FIGS. 10 and 11, the sump 40 can be a low portion of the container, with the container floor 10 sloping upwardly away from the sump 40. In FIG. 10, the sump 40 is a portion of the container 5 having an elevation head lower than the average elevation head of the container floor 10 adjacent the sump 40. As shown in FIG. 11, the sump 40 can be a discrete region of the container 5 having an elevation head or average elevation head less than the elevation head or average elevation head of the container floor 10 adjacent the sump 40. As shown in FIGS. 10 and 11, the container floor 10 can be sloped to the sump 40 and can be longitudinally and laterally extensive. The container floor 10 can be sloped to the sump 40. As disclosed herein, the sump 40 can be any of the structures identified as sump 40 herein. As shown in FIGS. 10 and 11, the container floor 10 can be generally merged with peripheral wall 20. The transition from the container floor 10 to the peripheral wall 20 can be considered to be the level above which more than about 80% of the liquid fabric treatment composition by weight resides when the container 5 is in an in use position prior to use.

The container floor 10, the sump 40, the peripheral wall 20, and the peripheral flange 30 can be formed from polypropylene and optionally include one or both of calcium carbonate and carbon black. The components of the container 5, including the container floor 10, the sump 40, the peripheral wall 20, and the peripheral flange 30, can be hydrophobic. The container floor 10, the sump 40, the peripheral wall 20, and the peripheral flange 30 can comprise a hydrophobic substrate. The substrate can be a polyolefin, biosourced polymer, or other material, by way of non-limiting examples. The substrate can be polypropylene having a weight fraction of calcium carbonate, and optionally include carbon black. Fabric treatment compositions 70 having a high weight fraction of water, for example more than about 95% by weight, alternatively more than about 97% by weight, alternatively more than about 98% by weight, with the upper bound being about 100%, are thought to have a sufficiently low contact angle with polypropylene such that little of the fabric treatment composition 70 is retained on the surface of the container 5 when the fabric treatment composition 70 is extracted from the container 5. One or more or all of the container floor 10, peripheral wall 20, sump 40 and the peripheral flange 30 can comprise a thermoset or thermoplastic polymer. One or more or all of the container floor 10, peripheral wall 20, sump 40 and the peripheral flange 30 can comprise a thermoset or thermoplastic polymer.

The fabric treatment composition 70 can have a contact angle with at least one of the container floor 10 and peripheral wall 20 that is less than about 90 degrees, alternatively less than about 70 degrees, alternatively less than about 60 degrees, alternatively between about 1 degree and about 50 degrees, alternatively between about 1 degree and about 40 degrees, alternatively between about 1 degree and about 35 degrees. The fabric treatment composition 70 can have a contact angle with the container floor 10, the peripheral wall 20, or both the container floor 10 and peripheral wall 20 that is between about 1 degree and about 90 degrees, alternatively between about 1 degree and about 70 degrees, alternatively between about 1 degree and about 60 degrees, alternatively between about 1 degree and about 50 degrees, alternatively between about 1 degree about 40 degrees, alternatively between about 1 degree and about 35 degrees.

In use, the fabric treatment composition 70 can be extracted by cannula 110 that is positioned such that the open end of the cannula 110 is placed proximal the container floor 10. The open end of the cannula 110 can be positioned such that it is between about 0.1 mm and about 2 mm, or alternatively between about 0.1 mm and about 1 mm, the sump terminus 43. The sump terminus 43 is taken to be the bottom of the sump 40 which is location in the sump 40 having the lowest sump elevation head. Without being bound by theory, it is thought container floor 10 and/or container peripheral wall 20 can comprise a material such that the fabric treatment composition 70 does not bead up when in contact with such parts of the container 5. It is thought that a greater degree of extraction from the container 5 can be obtained when the fabric treatment composition 70 being extracted wets the material forming the container and the extraction is being conducted proximal the sump 40. This is opposite what one skilled in the art might expect if the fabric treatment composition 70 were being dispensed via pouring from the container 5, in which beads of fluid might roll off the surface of the container 5 and provide for more complete pouring. A liquid can be considered to wet a surface, as opposed to bead up, if such liquid has a contact angle with the surface between about 0 and about 90 degrees.

The fabric treatment composition 70 can comprise a water soluble quaternary ammonium surfactant (quat). Typically, minimum levels of the water soluble quat included in the compositions of the present invention are at least about 0.01%, alternatively at least about 0.05%, alternatively at least about 0.1%, alternatively at least about 0.2% by weight, based on the total weight of the composition. Typically maximum levels of water soluble quaternary agent included in the composition are up to about 20%, alternatively less than about 10%, and alternatively less than about 3% based on the total weight of the composition. Typically, the agent is present in the composition in an amount of about 0.2% to about 1.0%.

Specifically, the water soluble quaternary compounds can be dialkly quaternary surfactant compounds. Suitable quaternary surfactants include, but are not limited to, quaternary ammonium surfactants having the formula:

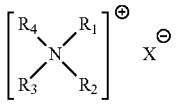

wherein $R_1$ and $R_2$ are individually selected from the group consisting of $C_1$-$C_4$ alkyl, $C_1$-$C_4$ hydroxy alkyl, benzyl, and —$(C_2H_4O)_xH$ where x has a value from about 2 to about 5; X is an anion; and (1) $R_3$ and $R_4$ are each a $C_6$-$C_{14}$ alkyl or (2) $R_3$ is a $C_6$-$C_{18}$ alkyl, and $R_4$ is selected from the group consisting of $C_1$-$C_{10}$ alkyl, $C_1$-$C_{10}$ hydroxy alkyl, benzyl, and —$(C_2H_4O)_xH$ where x has a value from 2 to 5. The asymmetric quaternary compounds can be compounds where R3 and R4 are not identical, and optionally one is branched and the other one is linear.

An example of a suitable asymmetric quaternary compound is ARQUAD HTL8-MS where X is a methyl sulfate ion, R1 and R2 are methyl groups, R3 is a hydrogenated tallow group with <5% mono unsaturation, and R4 is a 2-ethylhexyl group. ARQUAD HTL8-MS is available from Akzo Nobel Chemical of Arnhem, Netherlands.

An example of a suitable symmetric quaternary compound is UNIQUAT 22c50 where X is a carbonate and bicarbonate, R1 and R2 are methyl groups, R3 and R4 are C10 alkyl groups. UNIQUAT 22c50 is a registered trademark of Lonza and in North America is available thru Lonza Incorporated of Allendale, N.J.

Another example of a suitable water soluble quaternary compound is BARQUAT CME-35 which is N-Cetyl Ethyl Morpholinium Ethosulfate available from Lonza and having the following structure:

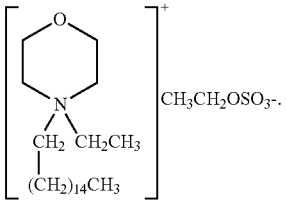

The fabric treatment composition 70 can have an oil component. The oil component can be a substantially water Insoluble material that is Incorporated into the fabric treatment composition 70 by way of a microemulsion. Typically the minimum levels of the oil component Included In the fabric treatment composition 70 are at least about 0.001%, alternatively at least about 0.005%, alternatively at least about 0.01%, and typically maximum levels of oil components are up to about 5%, alternatively less than about 3%, alternatively less than about 1.5%; with typical levels being In the range of about 0.05% to about 1%. The oil component can be a single component but is typically a mixture and usually represents the incorporation of some benefit agent into the fabric treatment composition 70. Typically the oil component is a perfume made up a mixture of components, but can also be non-perfume materials such as substituted or unsubstituted hydrocarbons and the like. For a sprayable fabric treatment composition 70, the oil component or mix can be a liquid at room temperature for ease of incorporation into the fabric treatment composition 70 and less potential for nozzle dogging on drying.

The oil components of the fabric treatment composition 70 can be substantially water insoluble and form a microemulsion. Substantially water insoluble means the clog P of the ingredients are greater than about 1. A clog P of about 1 indicates that the component would tend to partition into octanol about 10 times more than water. Components in the oil mixture can be branched hydrocarbons and perfumes when perfumes are used.

The fabric treatment composition 70 can comprise perfume. The fabric treatment compositions 70 described herein can also provide a "scent signal" in the form of a pleasant odor which provides a freshness impression to the treated fabrics. The scent signal can be designed to provide a fleeting or longer lasting perfume scent. When perfume is added as a scent signal, it is added only at very low levels, e.g., from about 0.001% to about 0.01% by weight of the usage of the fabric treatment composition 70.

When higher levels of fabric freshness are preferred, relatively higher levels of perfume can be added. These levels may be minimally from about 0.005%, alternatively at least about 0.01%, alternatively at least about 0.1%, and typically maximum levels of up to about 5%, alternatively less than about 3%, and alternatively less than about 1%, each of the percentages being by weight of the fabric treatment composition 70.

Any type of perfume can be incorporated into the fabric treatment composition 70 of the present invention. The perfume ingredients can be those suitable for use for application on fabrics and garments.

When long lasting fragrance odor on fabrics may desired, it is possible to use at least an effective amount of perfume ingredients which have a boiling point of about 240° C. or higher and possibly of about 250° C. or higher. It is also possible to use materials that can slowly release perfume ingredients after the fabric is treated by the fabric treatment composition 70.

Other perfume ingredients can act as solvents. In some cases this can help facilitate the incorporation of other perfume or oil ingredients into the overall fabric treatment composition 70. A particularly good example is benzyl alcohol. Benzyl alcohol has limited water solubility (clog P of about 1.2) and has been shown to help incorporate other perfume ingredient mixes into these fabric treatment compositions 70.

The fabric treatment composition 70 can comprise a branched hydrocarbon. An effective amount of a hydrocarbon with sufficient branching can be used which provides a stable, possibly well dispersed, possibly translucent, and even a clear, highly aqueous microemulsion wrinkle reduction composition. The hydrocarbon component may be saturated or unsaturated and possibly have a carbon content and structure so as to be a liquid at room temperature as opposed to being volatile or a solid.

One non-limiting example of a suitable branched hydrocarbon is ISOPAR V available from ExxonMobile Incorporated of Irving, Tex. Another suitable branched hydrocarbon is PERMETHYL 102A available through Presperse Incorporated of Somerset, N.J.

The branched hydrocarbons can be used at an appropriate level to make a possibly clear, stable microemulsion mixture in conjunction with the water soluble quaternary surfactant and perfume components. The branched hydrocarbon may be incorporated into the refresher spray separate from or pre-mixed in conjunction with perfume components.

Other optional, but possibly desirable ingredients which may optionally be used in the fabric treatment composition 70 include nonionic surfactants, buffering agents, odor control agents, perfume microcapsules, cyclodextrin, low molecular weight polyols, metal salts, antibacterial and preservative agents, pH adjustment agents, as well as other optional ingredients:

The fabric treatment composition 70 can comprise a nonionic surfactant. Examples of optional, but suitable nonionic surfactants are SURFYNOL 465, SURFYNOL 104 (2,4,7,9-tetramethyl-5-decyne-4,7-diol), and mixtures of the two. A suitable mixture is 3:1 SURFYNOL 465 to SURFYNOL 104. The SURFYNOL surfactants are available from Air Products and Chemicals, Incorporated of Allentown, Pa.

The nonionic can be selected from the group consisting of alkyl EO's & alkyl EO-PO's, APE's, EO-PO block polymeric surfactants, EO-PO amine polymeric surfactants, alcohols and branched alcohols, APG's, glucose amides, MEE's, silicone surfactants, and combinations thereof.

The fabric treatment composition 70 can comprise nonionic and anionic surfactants. Anionic surfactants are well-known to those skilled in the art. Examples include alkylbenzene sulphonates, particularly linear alkylbenzene sulphonates having an alkyl chain length of C8-C15; primary and secondary alkylsulphates, particularly C8-C15 primary alkyl sulphates; alkyl ether sulphates; olefin sulphonates; alkyl xylene sulphonates; dialkyl sulphosuccinates; and fatty acid ester sulphonates. Sodium salts are generally suitable.

The nonionic surfactant can be sulfates and sulfonated anionics. The nonionic surfactant can be selected from the group consisting of LAS, AS, AES, MES, AEC, SAS's with C8-C20 alkyl, aryl or alkylaryl linear or branched hydrophobes, and combinations thereof.

Nonionic surfactants that may be used in the fabric treatment composition 70 include the primary and secondary alcohol ethoxylates, especially the C8-C20 aliphatic alcohols ethoxylated with an average of from 1 to 20 moles of ethylene oxide per mole of alcohol, and more especially the C10-C15 primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The fabric treatment composition 70 can comprise a cationic surfactant. Cationic surfactants that may be used in the fabric treatment composition 70 include quaternary ammonium salts of the general formula R1 R2 R3 R4 N+X—wherein the R groups are independently hydrocarbyl chains of C1-C22 length, typically alkyl, hydroxyalkyl or ethoxylated alkyl groups, and X is a solubilising cation (for example, compounds in which R1 is a C8-C22 alkyl group, preferably a C8-C10 or C12-C14 alkyl group, R2 is a methyl group, and R3 and R4, which may be the same or different, are methyl or hydroxyethyl groups); and cationic esters (for example, choline esters and pyridinium salts.

The cationic surfactant can be selected from the group consisting of tetraalkylammonium salts, alkoxylated alkyl ammonium salts, alkyl pyridinium salts, pH-dependent primary, secondary or tertiary alkyl amines, and combinations thereof.

Another suitable nonionic class of surfactants are alkly polyglycoside surfactants. Examples of these surfactants are GLUCOPON 215, PLANTAREN 2000 N UP and GLUCOPON 425 and the like. These surfactants are available thru Cognis Oleochemicals of Selangor, Malaysia. These surfactants are particularly useful when the fabric treatment composition 70 pH is targeted away from neutral (pH 7) as they are stable across a broad range of pH's.

Another nonionic surfactant group that can be used when the product pH is at or near 7, are the SILWET silicone polyethers. Nonlimiting examples of these silicone polyethers are the SILWET materials which are available from GE Silicones. Representative SILWET silicone polyethers which contain only ethyleneoxy ($C_2H_4O$) groups are as follows:

| Name | Average Molecular Weight ("MW") in Daltons |
|---|---|
| L-7608 | 600 |
| L-7607 | 1,000 |
| L-77 | 600 |
| L-7605 | 6,000 |
| L-7604 | 4,000 |
| L-7600 | 4,000 |
| L-7657 | 5,000 |
| L-7602 | 3,000 |
| L-7622 | 10,000 |
| L-8600 | 2,100 |
| L-8610 | 1,700 |
| L-862 | 2,000 |

Nonlimiting examples of SILWET silicone polyethers which contain both ethyleneoxy ($C_2H_4O$) and propyleneoxy ($C_3H_6O$) groups are as follows:

| Name | Average MW in Daltons | EO/PO ratio |
|---|---|---|
| L-720 | 12,000 | 50/50 |
| L-7001 | 20,000 | 40/60 |
| L-7002 | 8,000 | 50/50 |
| L-7210 | 13,000 | 20/80 |
| L-7200 | 19,000 | 75/25 |
| L-7220 | 17,000 | 20/80 |

Nonlimiting examples of SILWET silicone polyethers which contain only propyleneoxy ($C_3H_6O$) groups are as follows:

| Name | Average MW in Daltons |
|---|---|
| L7500 | 3,000 |
| L7510 | 13,000 |
| L7550 | 300 |
| L8500 | 2,800 |

Suitable SILWETS aid in color restoration when included in the fabric treatment composition 70 in a sufficient concentration and can also provide softness, which is especially suitable when a silicone polymer leaves a rough feeling on the surface of the fabric. Nonlimiting examples of suitable SILWETS include L77, L7001, L7200, L7087 and, particularly, L-7600.

Some non-limiting suitable Dow Corning silicone polyethers include Dow Corning DC Q2-5247, (dimethyl, methylhydroxypropyl, ethoxylated propoxylated siloxane, primarily [CAS#68937-55-3] comprised of siloxane, EO, and PO. Other non-limiting examples of silicone polyethers that can be useful in the present invention include the following compounds available from Dow Corning: 193, 112, 8600, FF-400 Fluid, Q2-5220, Q4-3667, PP 5495, as well as compounds available from Toray Dow Corning Silicone Co., Ltd. known as SH3771C, SH3772C, SH3773C, SH3746, SH3748, SH3749, SH8400, SF8410, and SH8700, KF351 (A), KF352 (A), KF354 (A), and KF615 (A) of Shin-Etsu Chemical Co., Ltd., TSF4440, TSF4445, TSF4446, TSF4452 of Toshiba Silicone Company. Another non-limiting example is SLM 21200 from Wacker of Germany.

Some silicone polyethers (especially the more hydrophobic versions) may require additional emulsifying agents to make a stable spray fabric treatment composition 70. Such emulsifying agents are typically anionic, nonionic, cationic, amphoteric, or zwitterionic surfactants or mixtures thereof. Typically emulsifying agents and surfactants can also act as spreading agents on the fabric to spread out active ingredients such as the silicone polymers.

Typically, the minimum levels of the nonionic surfactant are at least about 0.01%, suitably at least about 0.05%, more suitably at least about 0.1% while typical maximum levels of nonionic surfactant can be up to about 5%, suitably less than about 3% and more suitably less than about 1.5%.

The fabric treatment composition 70 can comprise amphoterics, zwitterionics, and semi-polar surfactants. The fabric treatment composition 70 can comprise one or more of amine oxide, betaines, and sultaines.

The fabric treatment composition 70 can comprise a buffering agent. Buffering agents may be incorporated into the fabric treatment composition 70 to help control the pH of the product during making and in use. If the product is formulated at an alkaline pH, and sprayed during use, a buffer in the alkaline pH range can help prevent pH drop as a result of mixing with carbon dioxide from the air during spraying. Holding the pH at a targeted value can also help with neutralizing soils or malodors on fabric. Any suitable buffer, organic or inorganic, for the desired product pH can be used, providing at the level used it affords the mixture adequate stability. Suitable alkaline buffers include, but are not limited to, triethanolamine, glycine, arginine, carbonate salts, bicarbonate salts such as sodium bicarbonate, and the like.

The fabric treatment composition 70 can comprise an odor control agent. Optionally, an effective amount of malodor control agents may be used if desired to provide additional malodor capturing/sequestering effects.

The fabric treatment composition 70 can comprise perfume microcapsules.

The fabric treatment composition 70 can comprise cyclodextrin. As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the fabric treatment compositions 70 described herein can remain essentially unfilled (the cyclodextrin remains uncomplexed) while in solution, to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in fabric treatment compositions 70 which call for a level of cyclodextrin higher than its water solubility limit. Non-derivatised beta-cyclodextrin is generally not suitable when the fabric treatment composition 70 contains surfactant since it affects the surface activity of most of the suitable surfactants that are compatible with the derivatised cyclodextrins.

For controlling odor on fabrics, the fabric treatment composition 70 can be applied to the fabric as a spray. It is suitable that the fabric treatment compositions 70 of the present invention contain low levels of cyclodextrin so that a visible stain does not appear on the fabric at normal usage levels. Suitably, the solution used to treat the surface under usage conditions is virtually not discernible when dry. Typical levels of cyclodextrin in fabric treatment compositions 70 for usage conditions are from about 0.01% to about 5%, suitably from about 0.1% to about 4%, more suitably from about 0.5% to about 2% by weight of the fabric treatment composition 70. Fabric treatment compositions 70 having higher concentrations can leave unacceptable visible stains on fabrics as the solution evaporates off of the fabric. This is especially a problem on thin, colored, synthetic fabrics, to avoid or minimize the occurrence of fabric staining, it is suitable that the fabric be treated at a level of less than about 5 mg of cyclodextrin per gram of fabric, more suitably less than about 2 mg of cyclodextrin per gram of fabric. The presence of the surfactant can improve appearance by minimizing localized spotting.

The fabric treatment composition 70 can comprise low molecular weight polyols. Low molecular weight polyols with relatively high boiling points, as compared to water, such as ethylene glycol, propylene glycol, and/or glycerol are suitable optional ingredients for improving odor control performance of the fabric treatment composition 70 when cyclodextrin is present. Not to be bound by theory, it is believed that the incorporation of a small amount of low molecular weight glycols into the fabric treatment composition 70 enhances the formation of the cyclodextrin inclusion complexes as the fabric dries.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be filled by some malodor molecules of relatively smaller sizes. The glycol used can be glycerin, ethylene glycol, propylene glycol, diethylene glycol, dipropylene glycol or mixtures thereof, alternatively ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the fabric treatment composition 70 of the present invention.

Glycol can be added to the fabric treatment composition 70 of the present invention at a level of from about 0.01% to about 3%, by weight of the fabric treatment composition 70, suitably from about 0.05% to about 1%, more suitably from about 0.1% to about 0.5%, by weight of the fabric treatment composition 70. The weight ratio of low molecular weight polyol to cyclodextrin can be from about 2:1,000 to about 20:100, also suitably from about 3:1,000 to about 15:100, also suitably from about 5:1,000 to about 10:100, and also suitably from about 1:100 to about 7:100.

The fabric treatment composition 70 can comprise a metal salt. The fabric treatment composition 70 can include metallic salts for added odor absorption and/or antimicrobial benefit for the cyclodextrin solution when cyclodextrin is present. The metallic salts can be selected from the group consisting of copper salts, zinc salts, and mixtures thereof.

Metallic salts can be added to the fabric treatment composition 70 at a level of from about 0.05% to about 5%, alternatively from about 0.1% to about 3%, alternatively from about 0.2% to about 2% by weight of the fabric treatment composition 70. When zinc salts are used as the metallic salt, and a clear solution is desired, it may be helpful to adjust the pH of the solution to less than about 7 in order to keep the solution clear.

When any of the odor control agents are added to the fabric treatment compositions 70 of the present invention, they can be present at a level of from about 0.01% to about 5%; alternatively from about 0.1% to about 3%, and alternatively from about 0.2% to about 2% by weight of the fabric treatment composition 70.

The fabric treatment composition 70 can comprise antibacterial and/or preservative agents. The fabric treatment composition 70 of the present invention can comprise an effective amount of antimicrobial active, to kill, or reduce the growth of microbes, wherein the amount of antimicrobial active when used is suitably from about 0.001% to about 0.5%, alternatively from about 0.002% to about 0.2%, alternatively from about 0.005% to about 0.1%, by weight of the fabric treatment composition 70. The effective antimicrobial active can function as disinfectants/sanitizers, and is useful in providing protection against organisms that become attached to the fabrics.

Examples of additional preservatives include the hydantoin chemistry based materials. Suitable examples of hydantoin chemistry based materials include the dimethylol-5,5-dimethylhydantoin (DMDMH) based preservatives as exemplified by Dantogard 2000 and Dantogard Plus available from Lonza Group Ltd. of Basel, Switzerland.

Other non-limiting examples of suitable preservatives that could be used alone or in combination are 2-Methyl-4-isothiazolin-3-one and 2-Methyl-3(2H) isothiazolin exemplified by NEOLONE M-10 products as supplied by Rohm & Haas; 1,2 Benzisothiazolin 3-one based materials exemplified by KORALONE B-119 by Rohm & Haas; mixtures of Methylisothiazolinone and Benzisothiazolinone compounds exemplified by ACTICIDE MBS by Thor/Actichem; mixtures of Methylchloroisothiazolinone and Methylisothiazolinone as exemplified by KATHON GC supplied by Rohm & Haas; and 1,2-Benzisothiazolin-3-one exemplified by Proxel GXL as supplied by Arch Chemicals.

The fabric treatment composition 70 can comprise a pH adjustment agent. For lowering the fabric treatment composition 70 pH to a desired level, acidic materials can be utilized. Non-limiting examples of suitable acids are small organic acids, like citric acid and inorganic acids like sulfuric or hydrochloric acid. The acid used, and final pH of the fabric treatment composition 70, can be chosen to give a stable mix both chemically and physically.

For raising the fabric treatment composition 70 pH to a desired level, basic materials can be utilized. Non-limiting examples of suitable bases are typically low molecular weight inorganic bases like sodium hydroxide. The base used, and final pH of the fabric treatment composition 70, can be chosen to give a stable mix both chemically and physically. Suitably the fabric treatment compositions 70 of the present invention have a pH of from about 3 to about 11, alternatively from about 4 to about 10, and alternatively from about 5 to about 9.

The fabric treatment composition 70 can optionally comprise adjunct odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, malodor control agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers and anti-foaming agents, UV protection agents for fabrics and skin, sun fade inhibitors, anti-allergenic agents, enzymes, water proofing agents, fabric comfort agents, shrinkage resistance agents, stretch resistance agents, stretch recovery agents, functional microcapsules containing active materials such as perfumes, silicones, skin care agents, glycerin, and natural actives such as aloe vera, vitamin E, shea butter and the like, and mixtures thereof in addition to the silicone molecules. The total level of optional ingredients can be low, suitably less than about 5%, alternatively less than about 3%, and alternatively less than about 2%, by weight of the fabric treatment composition 70. These optional ingredients exclude the other ingredients specifically mentioned hereinbefore. Incorporating adjunct odor-controlling materials can enhance the capacity of the cyclodextrin to control odors as well as broaden the range of odor types and molecule sizes which can be controlled. Such materials include, for example, metallic salts, water-soluble cationic and anionic polymers, zeolites, water-soluble bicarbonate salts, and mixtures thereof.

The carrier for the fabric treatment composition 70 can be water. The liquid fabric treatment composition can contain between about 0% and about 99.5% by weight water. The liquid fabric treatment composition can contain between about 95% and about 99.5% by water. The liquid fabric treatment composition can contain between about 97% and about 99.5% by water. The water can be distilled, deionized, or tap water. Water can be useful for fabric wrinkle removal or reduction. Not wishing to be bound by theory, it is believed that water breaks many intrafiber and interfiber hydrogen bonds that keep the fabric in a wrinkled state. It can also swell, lubricate and relax the fibers to help the wrinkle removal process.

Water can also serves as the liquid carrier for the cyclodextrins, and can facilitate the complexation reaction between the cyclodextrin molecules and any malodorous molecules that are on the fabric when it is treated. The dilute aqueous solution can also provide the maximum separation of cyclodextrin molecules on the fabric and thereby maximizes the chance that an odor molecule will interact with a cyclodextrin molecule. Further, water can have an unexpected odor controlling effect of its own. It has been discovered that the intensity of the odor generated by some polar, low molecular weight organic amines, acids, and mercaptans is reduced when the odor-contaminated fabrics are treated with an aqueous solution. Not to be bound by theory, it is believed that water solubilizes and depresses the vapor pressure of these polar, low molecular weight organic molecules, thus reducing their odor intensity.

The level of liquid carrier in the fabric treatment composition 70 can be at least about 80%, suitably greater than about 90%, alternatively greater than about 95%, by weight of the fabric treatment composition 70.

Optionally, in addition to water, the carrier can contain a low molecular weight organic solvent that is substantially soluble in water. Non-limiting examples are ethanol, n-propanol, isopropanol, n-butanol, tert-butyl alcohol deodorized acetone, acetone, and the like, and mixtures thereof. Low molecular weight alcohols can help the treated fabric to dry faster. Other solvents can also be used such as ethers of ethylene glycol and propylene glycol (e.g., ethylene glycol monohexyl ether) and glycols such as glycerin, propylene glycol, dipropylene glycol, ethylene glycol, and the like. Other non-limiting examples include 1,3-propanediol, diethylene glycol, 1,2,3-propanetriol, propylene carbonate, phenylethyl alcohol, 2-methyl 1,3-propanediol, hexylene glycol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), other glycol ethers such as butyl carbitol and dipropylene glycol n-butyl ether, ester solvents such as dimethyl esters of adipic, glutaric, and succinic acids, and mixtures thereof. The optional solvent is also useful in the solubilization of some shape retention polymers and some silicone polymers described hereinbefore. The optional water soluble low molecular weight solvent can be used at a level of up to about 8%, typically from about 0.05% to about 8%, alternatively from about 0.1% to about 5%, alternatively from about 0.2% to about 3%, by weight of the total fabric treatment composition 70. Factors that need to be considered when a high level of solvent is used in the fabric treatment composition 70 are cost, odor, flammability, and environmental impact.

The fabric treatment composition 70 can be free from an emulsifier. The fabric treatment composition 70 can be free from one or more or all of the following: mono- and diglycerides and esters thereof, ethoxylated mono- and diglycerides, glyceryl esters, polyglyceryl esters, fatty carboxylates, sorbitan esters and polysorbates, fatty acid esters based on glycols and sugars, and lecithins.

The fabric treatment composition 70 can comprise from about 0.01% to about 1% by weight cationic surfactant, about 0.01% to about 1% by weight of a wetting agent, about 0.1% to about 1% by weight of a buffer, about 0.001% to about 1% of a biocide, and between about 0.001% to about 1% by weight of a pH adjuster. The fabric treatment composition 70 can comprise between about 0.001% and about 1% by weight perfume. The balance of the formula can be water. The wetting agent can be one or both of, by way of non-limiting example, ethoxylated 2,4,7,9-tetramethyl 5 decyn-4,7-dio (e.g. 0.01% to about 1% by weight of the fabric treatment composition 70) and 2,4,7,9-tetramethyl-5-decyne-4,7-diol (e.g. 0.01% to about 1% by weight of the fabric treatment composition 70. The buffer can be triethanolamine and can be at a level of about 0.30% by weight. The lubricant can be isoeicosane and can be at a level of about 0.20%. The biocide can be 1,2 benzisothiazolin-3-one (BIT) and can be at a level of 0.0085%. The pH adjuster can be hydrochloric acid. The cationic surfactant can be octadecyl,2-methylhexyl, dimethyl ammonium methylsulfate. The fabric treatment composition 70 can comprise SURFYNOL 465 and Surfynol 104. The fabric treatment composition 70 can comprise SURFYNOL 465 and Surfynol 104 in a 3:1 ratio by mass of SURFYNOL 465 to SURFYNOL 104. The fabric treatment composition 70 can comprise 2,4,7,9-tetramethyl-5-decyne-4,7,diol (10 EO's) and 2,4,7,9-tetramethyl-5-decyne,4,7,diol (with no EO's). The fabric treatment composition 70 can comprise 2,4,7,9-tetramethyl-5-decyne-4,7,diol (10 EO's) and 2,4,7,9-tetramethyl-5-decyne,4,7,diol (with no EO's) in a 3:1 ratio by mass of 2,4,7,9-tetramethyl-5-decyne-4,7,diol (10 EO's) to 2,4,7,9-tetramethyl-5-decyne,4,7,diol (with no EO's).

The fabric treatment composition 70 can be an aqueous composition. The fabric treatment composition 70 can be an aqueous composition comprising one or more of, or all of, anionic surfactant, cationic surfactant, nonionic surfactant, amphoteric surfactant, and perfume.

The container 5 disclosed herein can be used in a process treating a fabric comprising the steps of inserting the container 5 disclosed herein into a port 108 of a fabric refreshing cabinet device 101. The process can further comprise the step of preparing the fabric refreshing cabinet device 101 for operation. The process can further comprise the step of activating operation of the fabric refreshing cabinet device 101. The process can further comprise the step of dispensing the fabric treatment composition 70 from the container 5 onto a fabric contained in the fabric refreshing cabinet device 101.

The container 5 can be as follows with the numbers in brackets corresponding to how the container 5 may be described and claimed:

[1] A container 5 for a liquid fabric treatment composition 70 comprising:

a. a container floor 10 extending to a floor boundary 12;

b. a sump 40 adjacent to at least a portion of said container floor 10, wherein a portion of said container floor 10 adjacent said sump 40 has a container floor elevation head, wherein said sump has a sump elevation head less than said container floor elevation head adjacent said sump 40, at least a portion of said sump 40 being located on a longitudinal axis L of said container 5;

c. a peripheral wall 20 extending from said container floor 10; and d. a needle piercable membrane 60 operatively engaged with said peripheral wall 20 to define an interior volume 6, wherein said interior volume 6 contains between about 10 mL and about 100 mL of a liquid fabric treatment composition 70.

[2] The container 5 according to [1], wherein said container 5 comprises a peripheral flange 30 extending from said peripheral wall 20 in a direction away from said container floor 10 and said needle piercable membrane 60 is sealed to said peripheral flange 30.

[3] The container 5 according to [2], wherein said peripheral flange 30 extends entirely about said peripheral wall 20.

[4] The container 5 according to [3], wherein said needle piercable membrane 60 is sealed to said peripheral flange 30 entirely about said peripheral flange 30.

[5] The container 5 according to any one of [1] to [4], wherein said liquid fabric treatment composition 70 is provided in a volume such that there is at least about 2 mm of headspace between said needle piercable membrane 60 and said liquid fabric treatment composition 70.

[6] The container 5 according to any one of [1] to [5], wherein said liquid fabric treatment composition 70 is provided in a volume of between about 60 mL and about 80 mL.

[7] The container 5 according to any one of [1] to [6], wherein said liquid fabric treatment composition 70 contains between about 0% and about 99.5% by weight water.

[8] The container 5 according to any one of [1] to [7], wherein said container floor 10, said sump 40, said peripheral wall 20, and said peripheral flange 30 comprise a thermoset polymer.

[9] The container 5 according to any one of [1] to [8], wherein said container floor 10, said sump 40, and said peripheral wall 20 comprise a hydrophobic substrate.

[10] The container 5 according to any one of [1] to [9], wherein said liquid fabric treatment composition 70 is provided in a volume such that there is at least about 2 mm of headspace between said needle piercable membrane 60 and said liquid fabric treatment composition 70.

[11] The container 5 according to any one of [1] to [10], wherein said needle piercable membrane 60 comprises a material selected from the group consisting of metallic foil, polymer film, and combinations thereof.

[12] The container 5 according to any one of [1] to [11], wherein when said container 5 is resting on a flat surface with said container floor 10 oriented towards said surface said peripheral flange 30 is parallel to said surface.

[13] The container 5 according to any one of [1] to [12], wherein said liquid fabric treatment composition 70 is provided in a volume of between about 60 mL and about 80 mL.

[14] The container 5 according to any one of [1] to [13], wherein said liquid fabric treatment composition 70 contains between about 0% and about 99.5% by weight water.

[15] The container 5 according to any one of [1] to [14], wherein said liquid fabric treatment composition 70 is an aqueous composition comprising surfactant.

[16] The container 5 according to any one of [1] to [15], wherein said liquid fabric treatment composition 70 is free from mono- and diglycerides and esters thereof, ethoxylated mono- and diglycerides, glyceryl esters, polyglyceryl esters, fatty carboxylates, sorbitan esters and ply sorbates, fatty acid esters based on glycols and sugars, and lecithins.

[17] The container 5 according to any one of [1] to [16], wherein said liquid fabric treatment composition 70 has a contact angle with at least one of said container floor 10 and said peripheral wall 20 of between about 1 degree and about 90 degrees.

[18] The container 5 according to any one of [1] to [17], wherein said container 5 has a transverse axis T intersecting said longitudinal axis L and orthogonal to said longitudinal axis L wherein said container 5 comprises a plurality of said sumps 40 and said transverse axis T is between said sumps 40.

[19] A process for treating a fabric 107 comprising the steps of inserting the container 5 of any one of [1] to [18] into a port 108 of a fabric refreshing cabinet device 101, preparing the fabric refreshing cabinet device 101 for operation, and activating operation of the fabric refreshing cabinet device 101.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container for a liquid fabric treatment composition comprising:

a. a container floor extending to a floor boundary;

b. a sump adjacent to at least a portion of said container floor, wherein the portion of said container floor adjacent said sump has a container floor elevation head, wherein said sump has a sump elevation head less than said container floor elevation head adjacent said sump, at least a portion of said sump being located on a longitudinal axis of said container wherein the sump and container floor are configured to be received by a fabric refreshing device;

c. a peripheral wall extending from said container floor and each portion of the peripheral wall configured to intercept said container floor at a generally fixed of about 1 degree to less than about 90 degrees; and d. a membrane configured to be pierced by a needle and operatively engaged with said peripheral wall to define an interior volume, wherein said interior volume contains between about 10 mL and about 100 mL of the liquid fabric treatment composition.

2. The container according to claim 1, wherein said container comprises a peripheral flange extending from said peripheral wall in a direction away from said container floor and said needle pierceable membrane is sealed to said peripheral flange.

3. The container according to claim 2, wherein when said container is resting on a flat surface with said container floor oriented towards said flat surface, said peripheral flange is parallel to said flat surface.

4. The container according to claim 2, wherein said peripheral flange extends entirely about said peripheral wall.

5. The container according to claim 4, wherein said needle pierceable membrane is sealed to said peripheral flange entirely about said peripheral flange, and wherein the needle pierceable membrane opposes the container floor.

6. The container according to claim 5, wherein said liquid fabric treatment composition is provided in a volume such that there is at least about 2 mm of headspace between said needle pierceable membrane and said liquid fabric treatment composition.

7. The container according to claim 6, wherein said liquid fabric treatment composition is provided in a volume of between about 60 mL and about 80 mL.

8. The container according to claim 2, wherein said container floor, said sump, said peripheral wall, and said peripheral flange comprise a thermoset polymer.

9. The container according to claim 1, wherein said container floor, said sump, and said peripheral wall comprise a hydrophobic substrate.

10. The container according to claim 1, wherein said liquid fabric treatment composition is provided in a volume such that there is at least about 2 mm of headspace between said needle pierceable membrane and said liquid fabric treatment composition.

11. The container according to claim 1, wherein said needle pierceable membrane comprises a material selected from a group consisting of metallic foil, polymer film, and combinations thereof.

12. The container according to claim 1, wherein said liquid fabric treatment composition is provided in a volume of between about 60 mL and about 80 mL.

13. The container according to claim 1, wherein said liquid fabric treatment composition contains between about 0% and about 99.5% by weight water.

14. The container according to claim 1, wherein said liquid fabric treatment composition is an aqueous composition comprising surfactant.

15. The container according to claim 1, wherein said liquid fabric treatment composition is free from mono- and diglycerides and esters thereof, ethoxylated mono- and diglycerides, glyceryl esters, polyglyceryl esters, fatty carboxylates, sorbitan esters and ply sorbates, fatty acid esters based on glycols and sugars, and lecithins.

16. The container according to claim 1, wherein said liquid fabric treatment composition has a contact angle with at least one of said container floor and said peripheral wall of between about 1 degree and about 90 degrees.

17. The container according to claim 1, wherein said container has a transverse axis intersecting said longitudinal axis and orthogonal to said longitudinal axis wherein said container comprises a plurality of said sumps and said transverse axis is between said sumps.

18. A process for treating a fabric comprising steps of inserting the container of claim 1 into a port of a fabric refreshing device, preparing the fabric refreshing device for operation, and activating operation of the fabric refreshing device.

19. A container for a fabric treatment composition comprising:

a. a container floor extending to a floor boundary;

b. a sump adjacent to at least a portion of said container floor, wherein the portion of said container floor adjacent said sump has a container floor elevation head, wherein said sump has a sump elevation head less than said container floor elevation head adjacent said sump, at least a portion of said sump being located on a longitudinal axis of said container wherein the sump and container floor are configured to be received by a fabric refreshing device;

c. a continuous peripheral wall extending from said container floor;

d. a peripheral flange extending from said continuous peripheral wall in a direction away from said container floor; and e a membrane configured to be pierced by a needle and sealed to said peripheral flange to define an interior volume, wherein said interior volume is configured to contain between about 10 mL and about 100 mL of a liquid fabric treatment composition, and wherein the needle pierceable membrane opposes the container floor;

wherein said container floor and said continuous peripheral wall comprise a flow enhancing surface, such that at least one of the said container floor and each portion of the said continuous peripheral wall configured to have a contact angle with said liquid fabric treatment composition of between about 1 degree and less than about 90 degrees; wherein said liquid fabric treatment composition is provided in a volume such that there is at least about 2 mm of headspace between said needle pierceable membrane and said liquid fabric treatment composition; and wherein the liquid fabric treatment composition is an aqueous composition comprising surfactant.

20. The container according to claim 7, wherein said liquid fabric treatment composition contains between about 0% and about 99.5% by weight water.

* * * * *